United States Patent [19]

Bloomer

[11] 4,207,841

[45] Jun. 17, 1980

[54] DIPOLE ANTENNA FOR PROXIMITY FUZE

[75] Inventor: Thomas M. Bloomer, Baltimore, Md.

[73] Assignee: The United States of America as represented by the Secretary of the Army, Washington, D.C.

[21] Appl. No.: 594,632

[22] Filed: May 19, 1945

[51] Int. Cl.[2] ..... F42C 13/04; H01Q 1/28

[52] U.S. Cl. ..... 102/214; 343/705

[58] Field of Search ..... 102/70.2, 214; 250/2.21, 33.5, 33.91; 343/705, 708

[56] References Cited

U.S. PATENT DOCUMENTS

| | | | |
|---|---|---|---|
| 1,757,288 | 5/1930 | Bleeker | 102/20 |
| 2,113,136 | 4/1938 | Hansell et al. | 343/827 |
| 2,397,088 | 3/1946 | Clay | 343/708 |

FOREIGN PATENT DOCUMENTS

| | | | |
|---|---|---|---|
| 372206 | 6/1939 | Italy | 250/33.5 |
| 91592 | 2/1938 | Sweden | 102/70.2 |
| 524876 | 8/1940 | United Kingdom | 250/2.21 |
| 539224 | 9/1941 | United Kingdom | 250/2.21 |

*Primary Examiner*—Verlin R. Pendegrass

*Attorney, Agent, or Firm*—Nathan Edelberg; Robert P. Gibson; Saul Elbaum

EXEMPLARY CLAIM

1. In combination with a bomb or similar projectile intended to move rapidly through the air and having aerodynamic characteristics such that the longitudinal axis of said projectile will be substantially coincident with its trajectory, a dipole antenna mounted on a cylindrical projection which extends from the nose of said projectile, said antenna comprising a pair of extending arms normal to said longitudinal axis and on opposite sides thereof, a proximity fuse carried by said projectile, and means connecting said antenna to said fuse.

6 Claims, 3 Drawing Figures

DIPOLE ANTENNA FOR PROXIMITY FUZE

Figure 1:
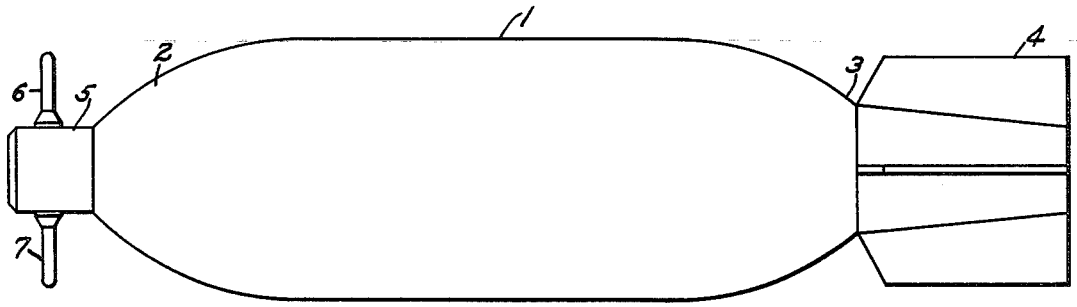

My invention relates to control devices and, in particular, relates to antennas for ultra-short electric waves which are to be mounted on bombs. It is frequently desirable to detonate bombs by electric circuits controlled by radiated electromagnetic waves. Such waves are ordinarily of ultra-short length and the antennas required for their radiation or reception are correspondingly short. They may, accordingly, be mounted on the nose or other convenient portion of the bombs which they are to control. However, various difficulties have arisen in the design and construction of such antennas, and it is an object of my invention to provide structural arrangement for such antennas which shall avoid the above-mentioned difficulties.

One of the difficulties met with has been in the provision of arrangements which shall radiate energy along the line of the central axis of the moving bomb. Certain prior art arrangements, with which I am familiar, tended to direct their radiation in the region surrounding such axis, but the radiation density along the axis itself was comparatively low. This defect of prior art arrangements I overcome by making the antenna in the form of a dipole or pair of oppositely-directed arms lying at right angles to the central axis of the bomb.

However, I have found that, if the dipole comprises a pair of simple cylindrical arms as above described, difficulty frequently arises because of excessive length of the arms if they are made resonant to the frequency ordinarily employed in the radiation. On the other hand, if the arms of the dipole are made long enough to resonate at the frequency ordinarily employed for the radiation, they interfere with the streamlined air-flow about the contour of the bomb and thereby produce highly undesirable effects. I find that this difficulty may be overcome by forming the arms of the dipole of proper length to conform with the proper streamlining of air-flow about the bomb, but expanding the outer ends of the dipole arms into spheres or similar surfaces to increase the electrostatic capacity sufficiently to cause the dipole to resonate at the desired frequency.

A third difficulty which I have found is that such dipole antennas are caused to vibrate mechanically by the flow of air past the bomb. This vibration produces electrical vibrations in the circuits of the radio system which utilizes the electric radiation, thereby producing undesirable responses often having the characteristic of false signals in such system. This difficulty I obviate by so fixing the natural frequency of mechanical vibration which is not in resonance with other frquencies at which the mechanical system of the bomb tends to vibrate, and which is also well removed from the filter pass bands of the radio circuits employed for controlling the bomb. One arrangement for thus fixing the mechanical resonant frequency of the antenna is to provide spherical, or other weight capable of being fixed at any desired distance along the dipole arms. Still another expedient that I have adopted is to alter the diameter of the dipole arm between the weight and the bomb, to vary its elastic properties and thereby change the frequency of mechanical vibration.

Still another expedient for minimizing mechanical vibration of the dipole arms is to make them in the form of hollow shells and to fill the hollow space with some material which can not be deformed without doing substantial mechanical work. Lead is one such material; granular tungsten oxide is another.

One object of my invention is, accordingly, to provide a bomb, projectile, or similar structure, with an antenna adapted to produce a substantial density of radiation at points lying along the projection of the central axis of the device.

Another object of my invention is to provide a bomb, projectile, or similar structure, with a dipole antenna having laterally projecting arms.

Still another object of my invention is to provide a bomb, projectile, or other similar structure, with a dipole antenna, the arms of which, respectively, have a physical length substantially shorter than that corresponding to one-quarter wave length of the radiation to which it is resonant.

A further object of my invention is to provide a bomb, projectile, or similar structure, with a dipole antenna tuned to resonate mechanically at a desired frequency.

A still further object of my invention is to provide a bomb, projectile, or other similar device, with a dipole antenna in which mechanical resonance is effectively damped.

Figure 2:
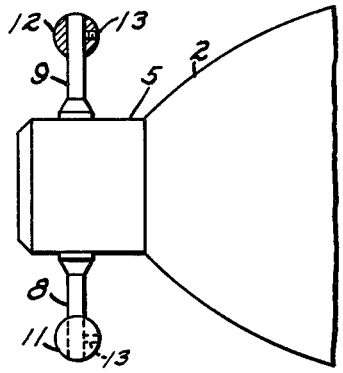
Figure 3:
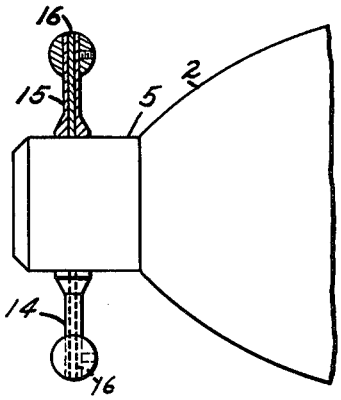

Other objects of my invention will become apparent upon reading the following description taken in connection with the accompanying drawing, in which:

FIG. 1 is a view in elevation of a bomb having a projecting nose on which is mounted a dipole antenna comprising two laterally extending arms;

FIG. 2 is a view of the end portion of a projectile similar to that shown in FIG. 1 and provided with a dipole antenna comprising laterally projecting arms having spherical weights which may be fastened at any desired distance in the region of the ends of the dipole; and FIG. 3 is a view, partly in section, of the end portion of a structure similar to FIG. 2 which the dipole antenna is provided with means for damping its mechanical vibrations.

Referring in detail to FIG. 1, a bomb, projectile, or other structure adapted to be projected through the air has a form approximating a cylinder 1 with a suitable streamlined nose portion 2 and a suitable streamlined tail portion 3, ending in directing fins 4 of a type conventional in the art. The bomb 1 may be filled, or partially filled, with any desired explosive or other material and may house a radio transmitter and/or receiver with arrangements for controlling the detonation or other behavior of the material so contained. Radio control circuits of the type just mentioned are well known in the art and form no part of my present invention so they need not be described in detail.

The nose 2 is provided with a projecting cylindrical portion 5 from diametrically opposite points on the sides of which there project the two arms 6 and 7 of a dipole antenna. The arms 6 and 7 are, of course, suitably insulated from the remainder of the bomb-casing 1 and provided with conventional lead wires running to the radio-control equipment housed inside the structure 1 and/or, as above mentioned. The arms 6 and 7 preferably project at right angles to the axis of the cylinder 1 and preferably extend in diametrically opposite directions. They may comprise any suitable conducting body in the form of slender cylinders which may have slightly rounded ends, if desired. The dipole comprising the arms 6 and 7 is excited to resonate in a manner well known in the radio art, the electrical vibrations of the respective arms 6 and 7 being 180° out of phase with each other. Such an arrangement will project a substantial amount of radiation directly along the projection of the axis of the cylindrical structure 1.

Referring in detail to FIG. 2, the dipole 6, 7 of FIG. 1 may be replaced by one comprising oppositely extending cylindrical arms 8, 9 having spherical end portions 11, 12 of substantially expanded diameters. The expanded end portions will provide capacitance which will cause the dipole to resonate at a wave length substantially more than four times the length of each arm.

In order to tune the mechanical resonating frequency of the dipole to any desired value, the spherical end portions 11, 12 may be provided with cylindrical holes so that they may be slid along the cylindrical arms of the dipole and fastened at the position producing the resonant frequency desired by means of setscrews 13. The frequency of mechanical resonance is preferably made one which lies outside the pass band of any electrical filter employed in the radio system installed in the bomb 1 and/or cylinder 5; and is also desirably set at a value different from any mechanical resonance which the flow of air along the contours of the bomb or other effects tend to produce within the confines of the bomb structure. It will, in general, be found that a relatively slight displacement of the position of the spheres will be sufficient to avoid the unwanted resonant frequencies above-mentioned so that such displacements may usually be made without altering the resonant frequencies of the electrical circuits concerned with the dipole.

FIG. 3 shows how a dipole of the character described in connection with FIG. 2 may be provided with means for effectively damping mechanical vibrations. The arms 14, 15 of the dipole are made hollow, thereby providing cylindrical chambers 16 which may be filled with lead or other metal which has a high coefficient of mechanical damping. Alternatively, the cylindrical chamber 16 may be filled with granules of some very dense substance such, for example, as tungsten oxide.

I claim as my invention:

1. In combination with a bomb or similar projectile intended to move rapidly through the air and having aerodynamic characteristics such that the longitudinal axis of said projectile will be substantially coincident with its trajectory, a dipole antenna mounted on a cylindrical projection which extends from the nose of said projectile, said antenna comprising a pair of extending arms normal to said longitudinal axis and on opposite sides thereof, a proximity fuse carried by said projectile, and means connecting said antenna to said fuse.

2. In combination with a cylindrical bomb casing having a rounded nose portion, a cylindrical projection concentric with the axis of said cylinder on said rounded end portion, and a dipole antenna comprising two extending arms mounted normal to the axis of said cylindrical extension on opposite sides thereof.

3. In combination with a bomb or other projectile having the form of a rounded-nose cylinder, a cylindrical projection concentric with the axis of said cylinder on said rounded nose portion a dipole antenna extending from said cylindrical projection and comprising a pair of laterally extending arms normal to the axis of said cylinder and on opposite sides thereof and terminating in end portions of relatively large surface area.

4. In combination with a bomb or similar projectile having a rounded nose-portion, a cylindrical projection concentric with the axis of said projectile on said rounded nose portion a dipole antenna comprising a pair of arms extending laterally from said cylindrical projection, movable members of relatively large surface area in sliding engagement with said arms and means for adjustably fixing the position of said members on said arms.

5. In combination with a projectile having a rounded nose-portion, a dipole antenna mounted thereon and comprising arm portions projecting laterally from said nose portion, said arm portions containing chambers filled with material capable of damping mechanical vibrations in said arm portions.

6. In combination with a projectile having the form of a round-nosed cylinder and intended to move rapidly through the air, a dipole antenna mounted on said projectile and comprising two arms on opposite sides of the axis of said cylinder and normal thereto, and means for damping mechanical vibrations of said arms.

* * * * *